US009370235B2

(12) United States Patent
Schuster

(10) Patent No.: US 9,370,235 B2
(45) Date of Patent: Jun. 21, 2016

(54) CONCERTINA APPLICATOR

(71) Applicant: GEKA GmbH, Bechhofen (DE)

(72) Inventor: Erwin Schuster, Bechhofen (DE)

(73) Assignee: GEKA GmbH, Bechhofen (DE)

( * ) Notice: Subject to any disclaimer, the term of this patent is extended or adjusted under 35 U.S.C. 154(b) by 0 days.

(21) Appl. No.: 14/492,804

(22) Filed: Sep. 22, 2014

(65) Prior Publication Data

US 2015/0083156 A1 Mar. 26, 2015

(30) Foreign Application Priority Data

Sep. 20, 2013 (DE) ..... 20 2013 104 300

(51) Int. Cl.
*A45D 40/26* (2006.01)
*A46B 9/02* (2006.01)

(52) U.S. Cl.
CPC ..... *A45D 40/265* (2013.01); *A45D 40/262* (2013.01); *A46B 9/021* (2013.01); *A46B 2200/106* (2013.01); *A46B 2200/1053* (2013.01)

(58) Field of Classification Search
CPC ..... A46B 9/021; A46B 2200/1053; A46B 2200/106; A46B 3/18; A45D 40/265; A45D 34/045; A45D 34/262
See application file for complete search history.

(56) References Cited

U.S. PATENT DOCUMENTS

| | | | | | |
|---|---|---|---|---|---|
| 2,496,010 | A * | 1/1950 | Lotters | 15/201 | |
| 3,998,235 | A * | 12/1976 | Kingsford | 132/218 | |
| 4,446,880 | A * | 5/1984 | Gueret et al. | 132/218 | |
| 4,527,575 | A | 7/1985 | Vasas | | |
| 4,572,224 | A * | 2/1986 | Rosenwinkel et al. | 132/218 | |
| 4,744,377 | A * | 5/1988 | Dolan, Jr. | A45D 40/265 | 132/218 |
| 6,591,842 | B2 * | 7/2003 | Gueret | 132/218 | |
| 7,810,509 | B2 * | 10/2010 | Kuzuu | 132/218 | |
| 7,827,998 | B2 * | 11/2010 | Rebours | 132/218 | |
| D642,806 | S * | 8/2011 | Schrepf | D4/136 | |
| 8,091,562 | B2 * | 1/2012 | Manici et al. | 132/218 | |
| 8,919,351 | B1 * | 12/2014 | Wang | 132/218 | |
| 2010/0037911 | A1 * | 2/2010 | Kim | 132/218 | |
| 2014/0105667 | A1 * | 4/2014 | Castex et al. | 401/129 | |
| 2014/0283868 | A1 * | 9/2014 | Zech | 132/218 | |

FOREIGN PATENT DOCUMENTS

| | | | | |
|---|---|---|---|---|
| DE | 3114748 A1 | 12/1982 | | |
| DE | 3434405 A1 | 4/1985 | | |
| FR | 2969909 A1 * | 7/2012 | ..... | A45D 34/048 |

* cited by examiner

*Primary Examiner* — Robyn Doan

(57) ABSTRACT

A cosmetic applicator with an applicator body, a wand, and a handle that is attached to the latter; the applicator body has a longitudinal axis that coincides with that of the wand; and the applicator body is composed of plates that are arranged in concertina-like fashion, are integrally joined to one another, and simultaneously constitute the support structure of the core-less applicator.

7 Claims, 11 Drawing Sheets

A - A

CONCERTINA APPLICATOR

FIELD OF THE INVENTION

The invention relates to a cosmetic applicator, particularly in the form of a mascara applicator.

BACKGROUND OF THE INVENTION

Cosmetic applicators are known in an extremely wide variety of forms.

Typical cosmetic applicators are composed of bristles extending radially out from a core. Depending on how rigid the bristles are embodied to be, more or less cosmetic compound can be held in the interstices between the bristles as they pass through the obligatory stripper, also called "wiper," which compound is then subsequently available for application. In general, applicators of this kind have to be dipped back into the receptacle numerous times in order to be "reloaded" with cosmetic compound.

Because of this, a variety of different applicators have been developed as alternatives in which the applying elements are not composed of bristles, i.e. individual rod-shaped flexible structures, but of plates. Typically, applicators of this kind are embodied so that they have a core that transitions into a coupling piece. Plates extend out from the core in a radial direction. Typically, these plates are embodied in the form of fins, which are shaped like slices of pie or like discs that extend more or less all the way around in the circumference direction and that the core passes through in approximately the region of their middle, holding the individual plates in position.

Particularly when relatively viscous cosmetic compound is to be applied, without having to dip the applicator repeatedly into the receptacle, however, such cosmetic applicators reach the limit of their usefulness despite their use of plates.

Because of this, the object of the present invention is to create an applicator that has a high storage capacity.

SUMMARY OF THE INVENTION

The cosmetic applicator according to the invention has an applicator body, a wand, and a handle connected to the latter. The applicator body typically has an imaginary longitudinal axis that coincides with that of the wand.

The applicator body is composed of plates that are arranged in concertina form and are as a rule integrally joined to one another and preferably at the same time, constitute the sole support structure of the applicator. This means that the applicator does not have a separate core in the sense that a rod being provided that extends like a backbone, uninterrupted from the coupling piece to the distal end (i.e. the end oriented away from the coupling piece) of the applicator, from which the individual plates protrude outward. Instead, the applicator is composed solely of the plates that are integrally joined to one another, i.e. transition into each other in such a way that they are fused to one another, in other words the plates are all produced in the same injection molding procedure. That means that the sentence directly before can serve as a substitute for the expression "in concertina fashion".

The plates here are arranged in concertina fashion; in other words, in at least some regions, immediately adjacent plates enclose an angle with each other. In this way, local pockets are produced between the plates, which pockets can store a considerable quantity of cosmetic compound.

In the context of the invention, a plate is understood to be a flat section that is not necessarily completely planar, but is instead intrinsically warped as a rule, which constitutes two large main surfaces whose surface area is larger by a factor of at least 5, but better still by a factor of at least 10 than the surface area of all other secondary surfaces of the section. Preferably, such a plate is characterized in that it is intrinsically closed, i.e. does not have any breaks.

The expression "local pocket" here is understood to be a structure that is not completely continuous in the circumference direction, but is closed toward at least two sides. A pocket therefore differs from the annular interstice between two plates that are immediately adjacent, but both extend in the radial direction at approximately right angles from the core of the applicator so that an annular interstice is formed between them.

Preferably, adjacent plates—with the exception of the beginning and/or ending plates—are integrally joined to one another essentially only along their outer edge. In some cases, a linear or arc-like connection along a single outer edge is sufficient. In other cases, a linear connection on two respective outer edges is sufficient. In still other cases, this concept is understood to include any arrangement in which two plates are joined to each other along two outer edges sharing a corner, each along a respective flat strip that extends along the above-mentioned outer edges.

In a preferred embodiment option, each pair of plates forms a V-shaped element and the applicator is composed of a plurality of V-shaped elements that are integrally joined to one another along their outer edges. The pockets that this produces, which are open not only at both of their ends, but also on the side toward which the two V-shaped legs extend away from each other, are therefore of the maximum size. The hair or eyelashes to be treated can be easily inserted into these pockets in order to be loaded with the cosmetic compound stored therein. As a result, such a design is very attractive, particularly for mascara applicators.

In another embodiment option, each plate—with the exception of the beginning and/or ending plates—is integrally joined to an adjacent plate both along its outer edge and along its inner edge. In this way, the applicator can be embodied so that each set of four plates forms an X-shaped element and the applicator is composed of a plurality of X-shaped elements that are integrally joined to one another along their outsides. This produces an applicator with different pockets.

Between each pair of immediately adjacent X-shaped elements, a respective inner pocket is produced here, which is open toward two diametrically opposing end surfaces and is otherwise intrinsically closed. In addition, outer pockets are formed between the legs of an individual X-shaped element. Particularly when using the applicator as a mascara applicator, these outer pockets are very useful because a relatively large amount of cosmetic compound can be stored in these pockets and the pockets can be easily accessed by the eyelashes.

In addition, protection is also sought for a cosmetic applicator with an applicator body, a wand, and a handle connected to the latter, which has a longitudinal axis that coincides with that of the wand and has an applicator body, which is composed of plates. On all sides, these plates enclose with the imaginary longitudinal axis of the applicator an angle of at least 50° and better still at least 70°, i.e. protrude entirely or largely at right angles to the imaginary longitudinal axis of the applicator.

In this case, pockets for accommodating the cosmetic are formed between adjacent plates, which pockets are open only toward one side of the applicator or toward two immediately adjacent sides of the applicator. In addition, the plates are connected to one another so that the applicator has no core from which the plates protrude outward.

Preferably, an applicator according to the invention is embodied so that the applicator body has a plurality of preferably intrinsically planar side surfaces and from each of the side surfaces, a number of pockets are accessible, which are closed in relation to a plurality of other side surfaces. This produces pockets that are also able to store very thin, fluid cosmetic whenever the cosmetic applicator is held in an appropriately oriented fashion.

Preferably, the majority of the pockets are deep enough that viewed in the direction of their greatest depth, they intersect the longitudinal axis L of the applicator body or even cross it, which is better still. In this way, it is possible to embody an applicator that is flexible even in a direction transverse to its longitudinal axis. It is only necessary to appropriately select the thicknesses of the plates as a function of the plastic material used for the plates. Ideally, this requirement naturally applies to all pockets, with the exception of the plate situated at the beginning or end.

In a preferred exemplary embodiment, the plates are quadrangular. Ideally, each plate—with the exception of the beginning and/or ending plates—integrally transitions along its entire length into an adjacent plate in a region along two outer lateral edges that are adjacent to each other by sharing a corner. A quadrangular embodiment is not absolutely mandatory, but is advantageous. If the plates transition into one another in this way, a part of the one plate is simultaneously also a part of the immediately adjacent plate. A pocket can be formed between these two plates, at the place where they separate from each other. It is thus possible, using a relatively simple tool that is composed of two mold halves that can be lifted away from each other by means of a movement in a straight line, to produce a one-piece applicator with a number of pockets in one injection-molding procedure—preferably in one shot.

The plates are "self-supporting" so that aside from the plates, no other elements or sections are required in order to produce an applicator that properly withstands the forces that occur during application.

Typically, the applicator according to the invention is composed of one piece. Preferably, it is made of plastic. It can, however, also be composed of other materials such as metal that can be processed using the die-casting process.

Other advantages, possible embodiments, and functions ensue from the following exemplary embodiments that are described in conjunction with the figures.

DETAILED DESCRIPTION OF THE PREFERRED EMBODIMENTS

Figure 1:
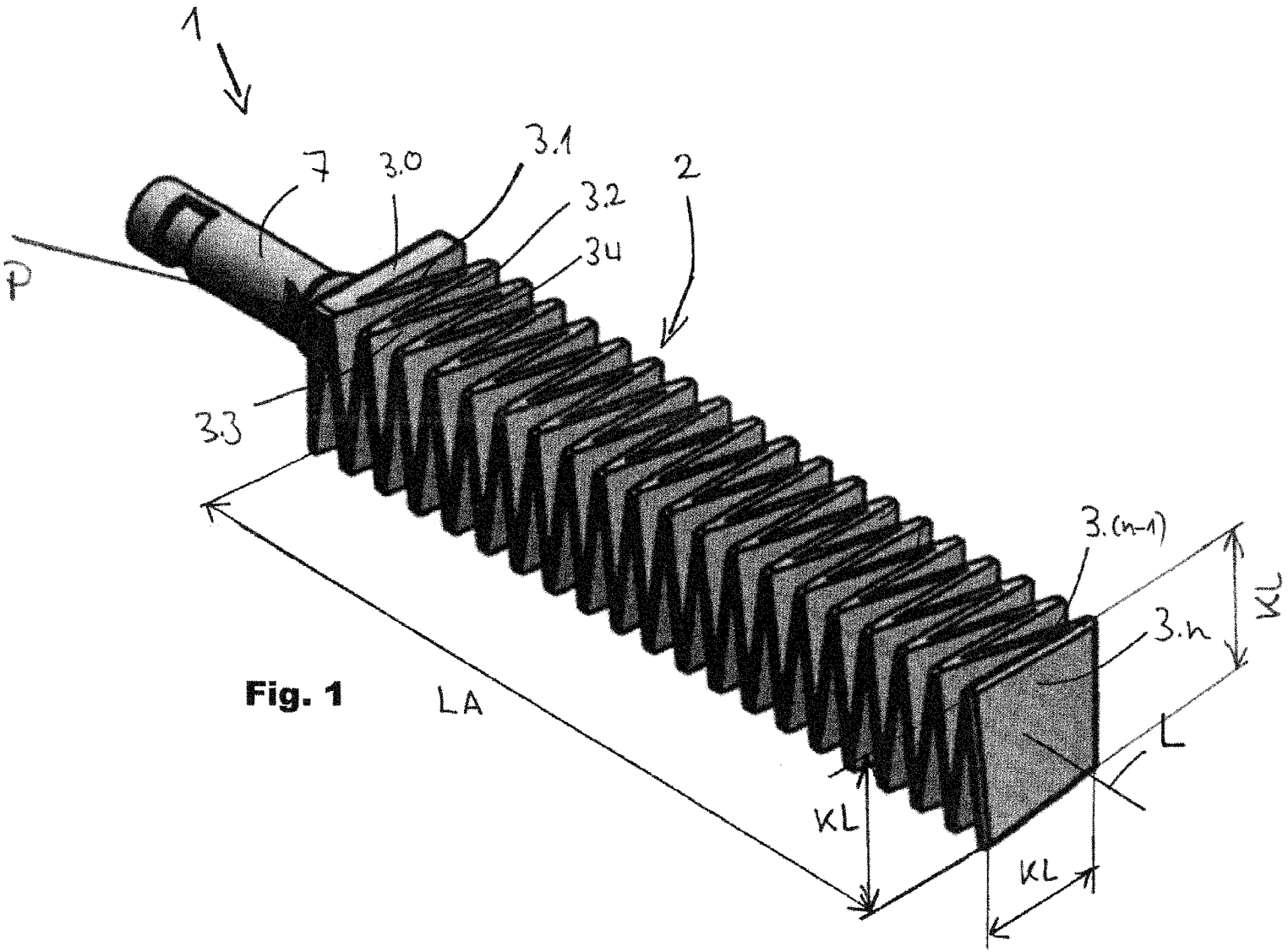
FIG. 1 is a perspective view of a first exemplary embodiment of the invention.
Figure 5:
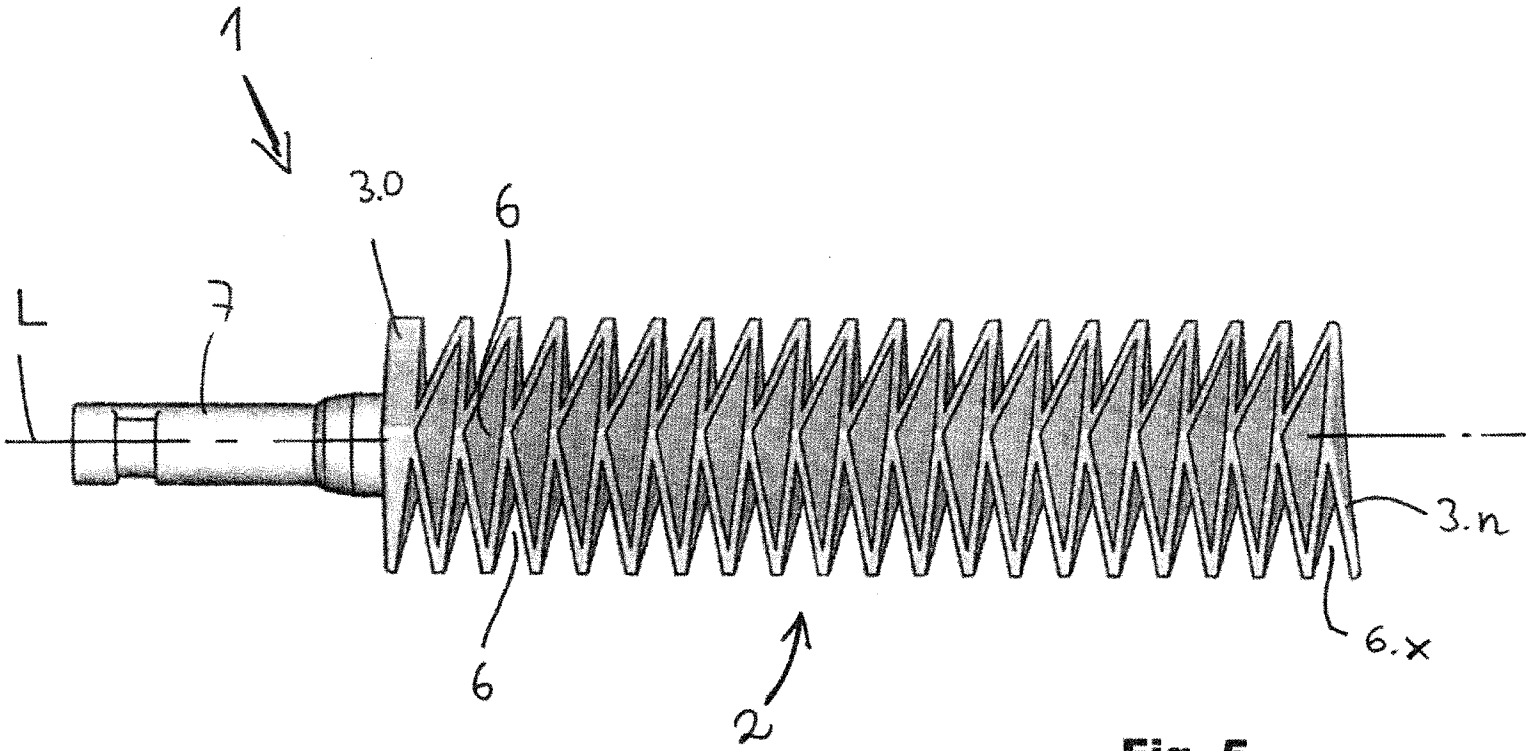
FIG. 5 shows a side view of the applicator, viewed in the direction of the arrow P shown in FIG. 1; in other words, the viewing direction is aligned precisely so that the observer is looking at a corner of the applicator from the side.

FIGS. 1, 3, and 5 provide the best view of a first exemplary embodiment of the applicator according to the invention.

The reference numeral 1 is used to identify the entire applicator, which is preferably used to apply mascara compound to the eyelashes and because of this, preferably has dimensions within the following ranges: LA≤40 mm, EL≤12 mm. In this case, the two edge lengths EL shown in FIG. 1 are only preferably essentially the same size.

The applicator 1 is composed of the applicator body 2 and the coupling section 7 connected thereto. By means of this coupling section, the applicator is as a rule connected to a wand, not shown here, which is in turn connected to a handle.

As is evident, the applicator body is composed exclusively of a number of plates (3.0, 3.1, 3.2, 3.3, 3.4 to 3.*n*). The plates 3.0 and 3.*n* are so-called end plates and are therefore specially shaped. All of the other plates 3.1 through 3.(*n*−1) are either identical and alternately positioned (preferred) or repeat according to a continuously repeating pattern so that the applicator has plates arranged in concertina-like fashion. This applicator does not have a tubular or rod-shaped core that forms a backbone so to speak from which the individual plates protrude out radially.

FIG. 3 shows the plates 3.1 and 3.2 shown in FIG. 1, in a detached form. Each of the plates 3.1 and 3.2—as well as all the other plates 3.3 through 3.($n$−1)) comprising the applicator—is a structure that has two main surfaces 4 and four secondary surfaces 5. As is clear from the drawing, each of the two main surfaces has a surface area that is several times greater than the surface area of each of the secondary surfaces—and to be specific, is preferably greater than them by a factor of at least 7.

For the number of plates that is symbolized by the variable n, preferably, n>20 and ideally, n>40.

Each of the plates of this exemplary embodiment has a rectangular, preferably precisely square, cross-section with the edge length EL, when they are projected into a plane oriented normal to the longitudinal axis L. In this exemplary embodiment, all of the plates have the same outer edge lengths so that on the whole, a block-shaped applicator body 2 is produced, with a cross-sectional form that remains constant in the direction of the longitudinal axis L.

Preferably, the surface area of each of the plates is intrinsically closed, i.e. has no openings or windows. It is particularly advantageous if the plates are each particularly thin-walled and have a plate thickness D<1 mm, or better still <0.7 mm, see FIG. 1.

Figures 2, 3A, 3B, 3C, 4:
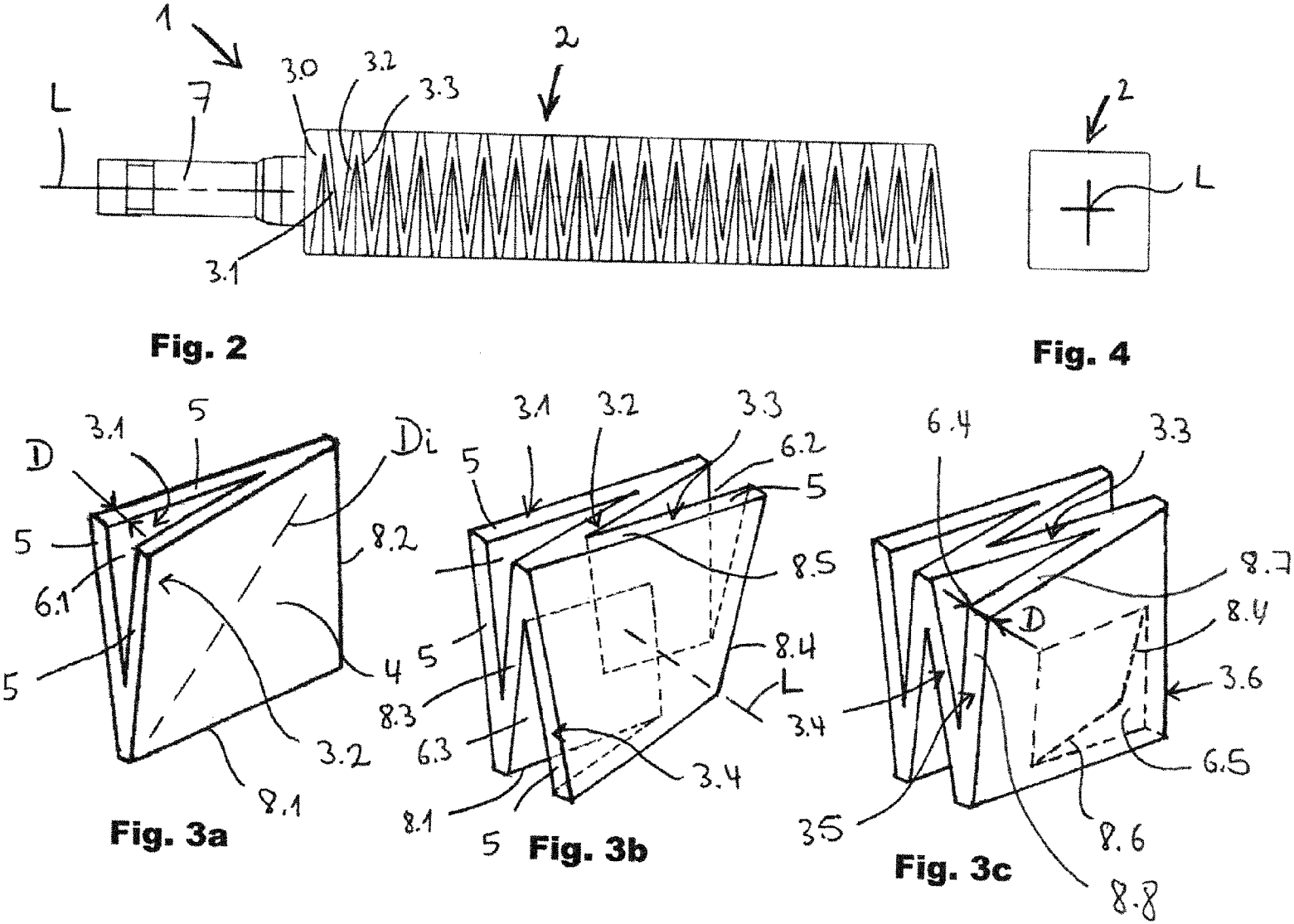
FIG. 2 shows a side view of the applicator according to FIG. 1.
FIGS. 3*a* through 3*c* show the system that the applicator according to FIGS. 1 and 2 follows.
FIG. 4 shows the cross-sectional profile of the applicator according to FIGS. 1 and 2 when viewed in a direction parallel to its longitudinal axis L.

The plates begin to transition into one another, as shown by FIG. 3*a* with the plates 3.1 and 3.2: two adjacent plates are integrally fused to each other along two lateral edges 8.1 and 8.2. Each of the two plates is warped essentially around its main surface diagonal Di, which is depicted with a dashed line in FIG. 3*a*, similar to the way in which a thin piece of sheet metal bends when it is supported at two opposing corners and a force is exerted on it in the region of its diagonals. In this way, the two plates 3.1 and 3.2 form an element with a pocket 6.1 that is open toward the front/top, i.e. with a pocket that is open on two sides of the applicator that share a corner and is otherwise closed.

This system is conceptually continued with each adjacent plate, see FIG. 3*b*. Thus the plate 3.2 has a plate 3.3 placed against it, which is fused to it along the front lateral edge 8.3 and along the lower lateral edge 8.1 that is only partially visible in FIG. 3*b* so that now the plates 3.2 and 3.3 in turn form an element with a pocket 6.2 that is open toward the rear/top in FIG. 3*b*.

It is also clear from FIG. 3*b* that conceptually, a plate 3.3 is in turn placed against a plate 3.4, which is fused to it along the rear lateral edge 8.4 and along the upper lateral edge 8.5, so that the plates 3.3 and 3.4, as shown in FIG. 3*b*, form an element with a pocket 6.3 that is open toward the front/bottom.

Conceptually, this pattern repeats continuously. Thus, FIG. 3*c* shows how a plate 3.4 is placed against another plate 3.5, which is fused (or merged) to the plate 3.4 along the rear lateral edge 8.4 and along the lower lateral edge 8.6 and forms another pocket that is open toward the front/top. As shown in FIG. 3*c*, a plate 3.5 is conceptually placed against a plate 3.6, which is fused to the plate 3.5 along its upper lateral edge 8.7 and along its front lateral edge 8.8 and forms a pocket 6.5 that is open toward the rear/bottom. This pattern continues until the other end of the applicator is reached.

In this way, alternating, diametrically opposed pockets 6.1 through 6.*n* are formed. Each of these pockets 6 here is closed along two sides that share a corner and open along two other sides that share a corner. The respective pocket serves on the one hand to store cosmetic compound, but on the other hand, is easily accessible for the eyelashes and in a mascara applicator, provides an outstanding material application without the need for repeated dipping while simultaneously achieving a good combing action. Preferably, each of the pockets has an essentially rectangular form, as shown by the dashed lines in FIG. 3*b*. In some instances, however, it is not a problem if the pockets are only triangular in form, which is not shown in the drawings.

As is already evident from FIG. 3*b*, the pockets can each be deep enough that they intersect with or preferably, even extend across the center longitudinal axis L.

Figure 6:
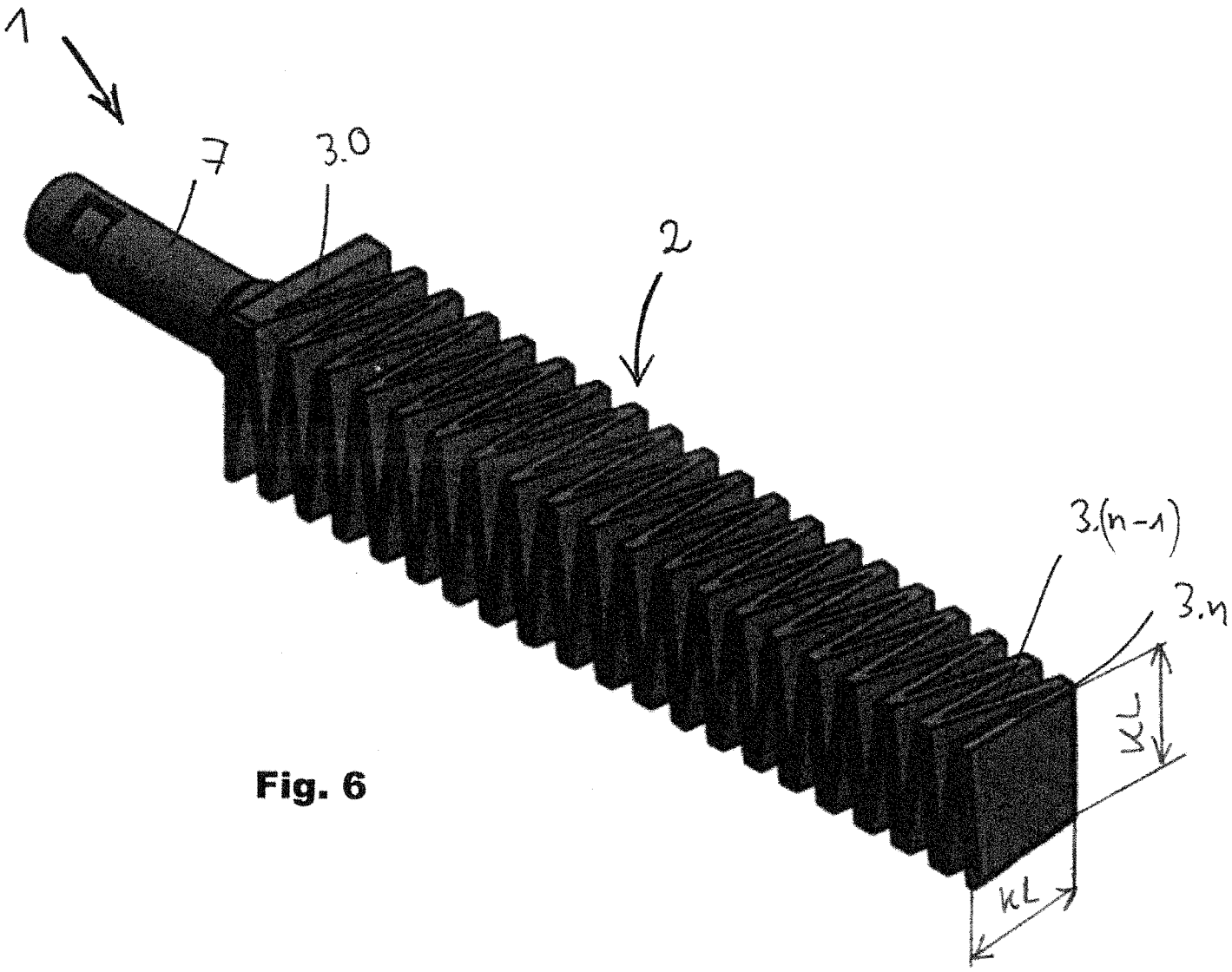
FIG. 6 shows a perspective view of a second exemplary embodiment of the invention.
Figure 7:
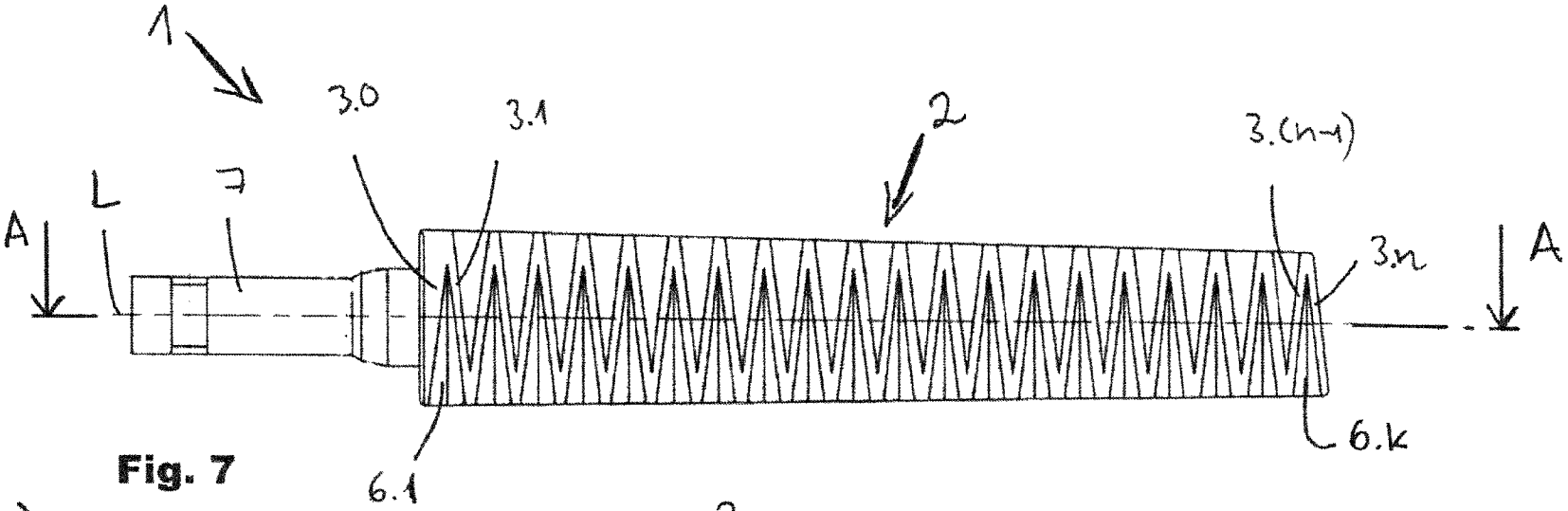
FIG. 7 shows a side view of the applicator according to FIG. 6.
Figure 8:
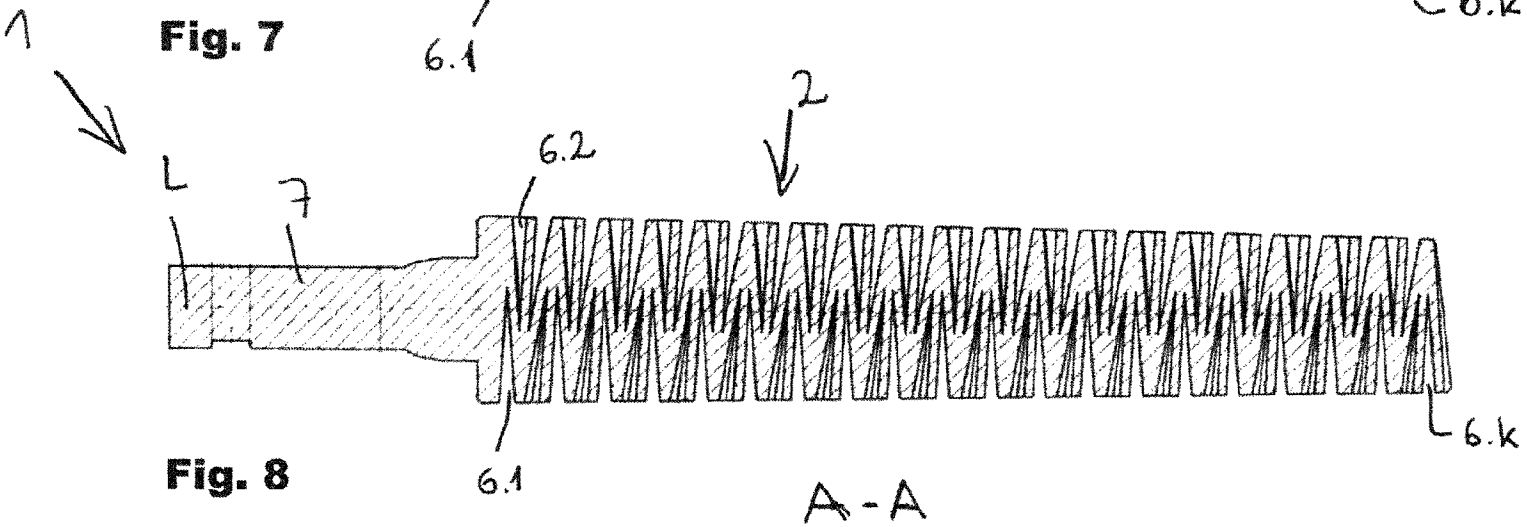
FIG. 8 shows a side view in the viewing direction A-A, which is indicated in FIG. 7.
Figure 9:
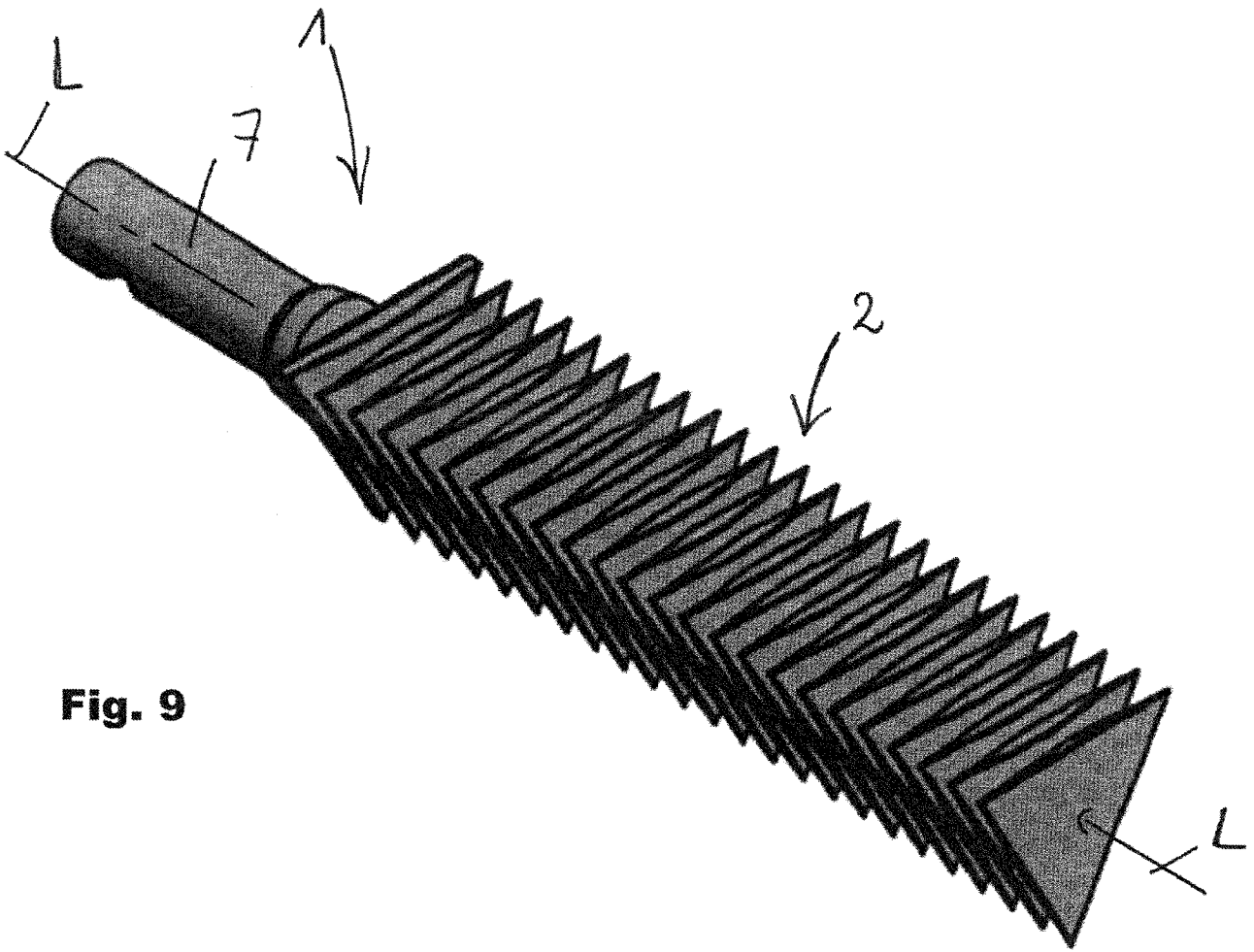
FIG. 9 shows a perspective view of a third exemplary embodiment of the invention.
Figure 10:
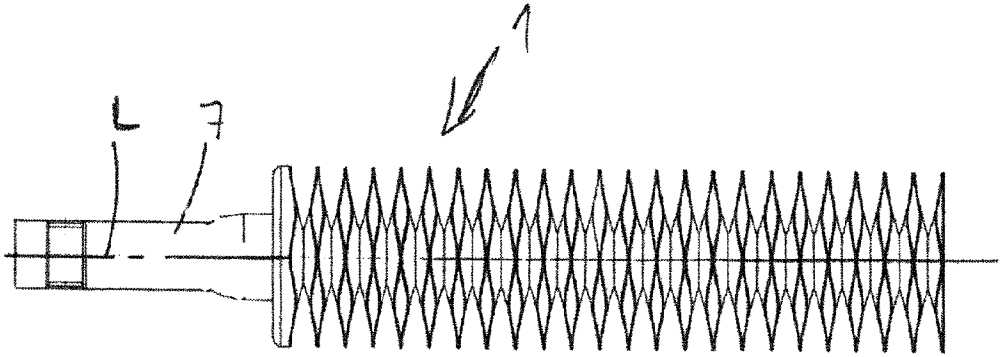
FIG. 10 shows a view of the applicator according to FIG. 9 from below.
Figure 11:
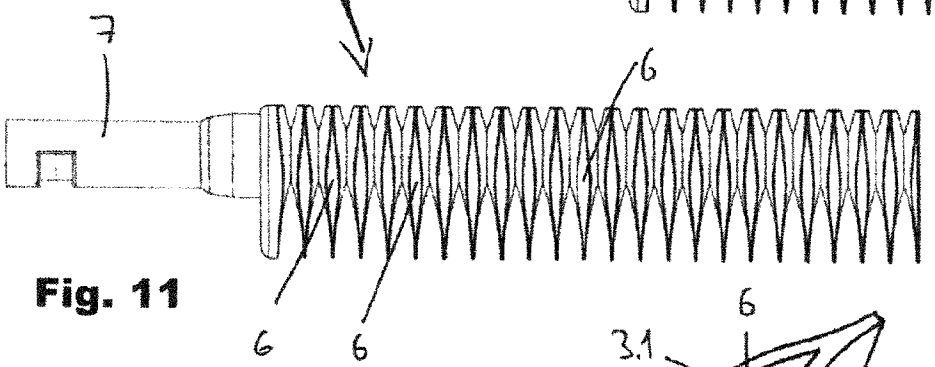
FIG. 11 shows a view of the applicator according to FIG. 9 from the side.
Figure 12:
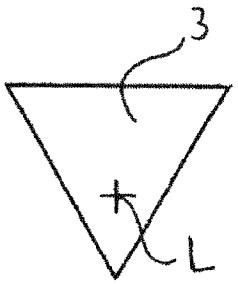
FIG. 12 shows the profile that the plates have when viewed in a direction parallel to the longitudinal axis of the applicator.

FIGS. 6 through 8 show another exemplary embodiment of the applicator. This second exemplary embodiment differs from the first exemplary embodiment only by means of the cross-sectional form described in greater detail below, so that the other descriptions that have been provided above for the first exemplary embodiment apply to this exemplary embodiment as well.

As is shown most clearly in FIG. 6, the outer edge length of each of the plates increases from the distal end (the end oriented away from the coupling section 7) of the applicator body toward the proximal end, thus on the whole yielding a truncated pyramid-shaped applicator body with a cross-sectional form that tapers toward the distal end.

FIG. 8 is of particular interest for understanding the invention; it shows a section along the intersecting plane A-A in FIG. 7, and—except for its tapering toward the distal end—offers a view that is comparable to the one that would also be produced with a corresponding section indicated in FIG. 2 with the letters B-B. This drawing clearly shows the plate-shaped structure and the fact that all of the pockets are deep enough that, viewed in the direction of their greatest depth, they extend across the longitudinal axis L of the applicator body.

FIGS. 9 through 14 show another exemplary embodiment. This applicator is also composed of plates that form pockets that follow the definition given at the beginning so that this applicator is ultimately composed of plates arranged in concertina-like fashion.

The plates used here are preferably triangular.

Figure 13:
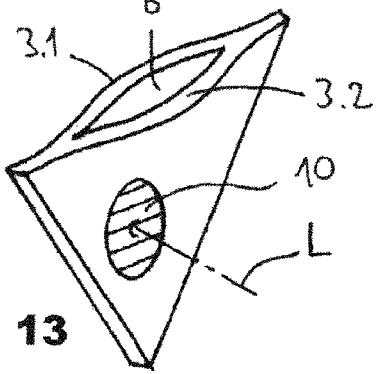
FIG. 13 shows a first variant of how a single pocket can be formed between two plates.

In this case, each pair of plates, which is composed of two plates 3.1 and 3.2 that integrally transition into each other, forms a pocket 6 between the two plates, which pocket is open toward only one side of the applicator, as shown in FIG. 13. Alternatively, a plate pair can form a plurality of pockets, as shown in FIG. 14 and in FIGS. 10 and 11.

Figure 14:
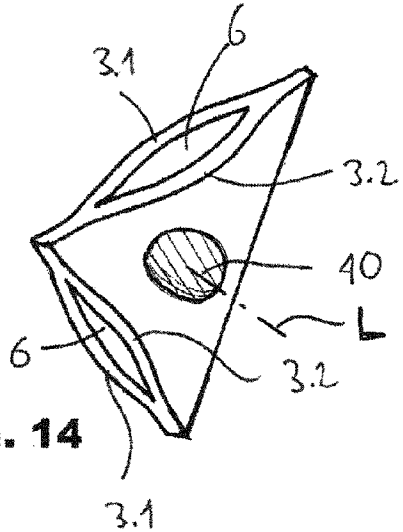
FIG. 14 shows a second variant of how a plurality of pockets can be formed between two plates.
Figure 15:
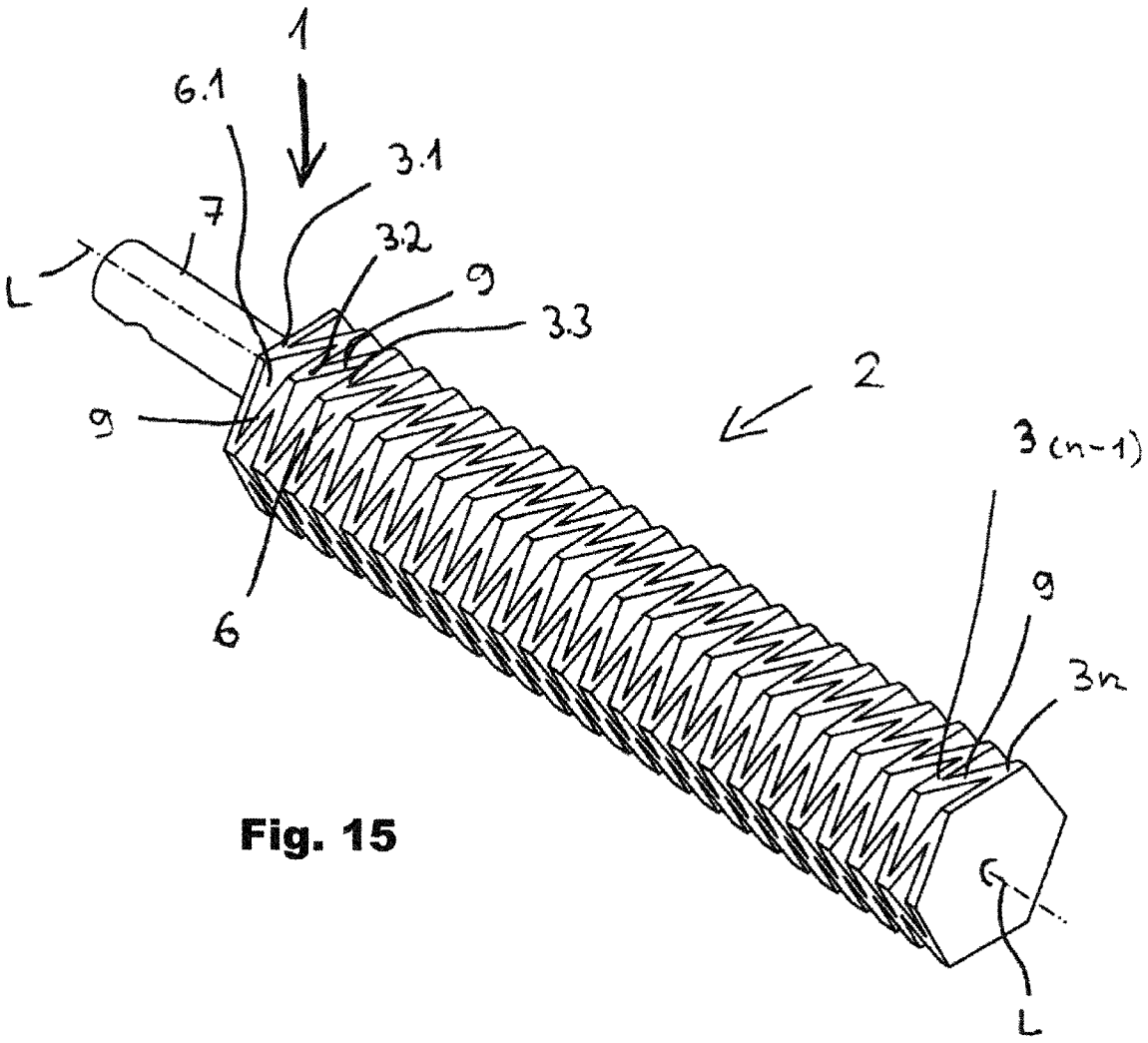
FIG. 15 shows a perspective view of a fourth exemplary embodiment of the invention.
Figure 16:
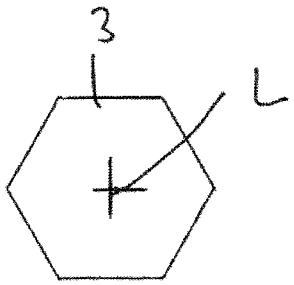
FIG. 16 shows the profile that the plates have in the fourth exemplary embodiment when viewed in a direction parallel to the longitudinal axis of the applicator.
Figure 17:
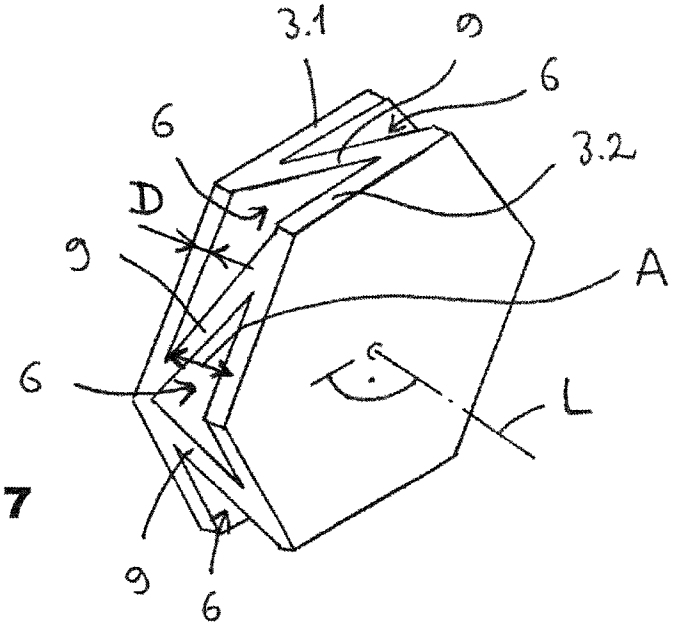
FIG. 17 shows that respective pairs of plates are continuously spaced apart from each other and are oriented essentially at right angles to the longitudinal axis; the plates, together with the connecting plates that connect them, form an element that repeats regularly, with a plurality of these elements constituting an applicator.

Adjacent plate pairs are integrally connected to one another, as shown by the connecting point 10, which is cut through and therefore is depicted with crosshatching in FIGS. 13 and 14, i.e. as a rule, all of the plates are "injection molded onto one another" thus all form a single piece.

In this embodiment, it is noteworthy that the coupling piece 7 of the applicator is preferably not attached centrally to the triangular plates, but is instead attached at a position that is offset toward one broad side of the plates. The intersecting points 8 via which the individual plate pairs are integrally connected to one another is offset in a corresponding fashion.

FIGS. 15 through 18 show another exemplary embodiment. This applicator is also composed of a number of polygonal plates 6, preferably embodied in a hexagonal form. The uniformly polygonal plates 6 are not situated directly adjacent to one another, but instead extend at right angles to the longitudinal axis and are uniformly spaced apart from one another by a distance A, see FIG. 17, plates 3.1 and 3.2. The polygonal plates 6 are connected by means of intermediate plates 9 that are inclined relative to the longitudinal axis. The intermediate plates are preferably arranged so that six pockets 6 for containing cosmetic are formed between two spaced-apart, adjacent polygonal plates 3. Each of these pockets is open on two sides of the applicator that share a corner and is otherwise closed.

An exemplary embodiment that is not shown in the drawings corresponds to the above-described exemplary embodiment with the sole difference being that the polygonal plates are octagonal.

FIGS. 19 through 22 show another exemplary embodiment. In this case, each set of 4 plates, which meet at their preferably linear edges situated in the vicinity of the middle and integrally transition into one another there, form an X-shaped element.

The applicator is composed of a number of such X-shaped elements, preferably at least 15 of them. Consequently, this design likewise produces an applicator with plates arranged in a concertina-like fashion; immediately adjacent X-shaped elements are integrally connected to one another at their respective outer edges oriented away from the middle of the applicator. The above-mentioned connection is preferably embodied as a common connecting line or better still, as an essentially point-shaped connection.

It is particularly preferable if at least a part or better still, all of the plates have a convex and suitably round outer edge.

Figure 18:
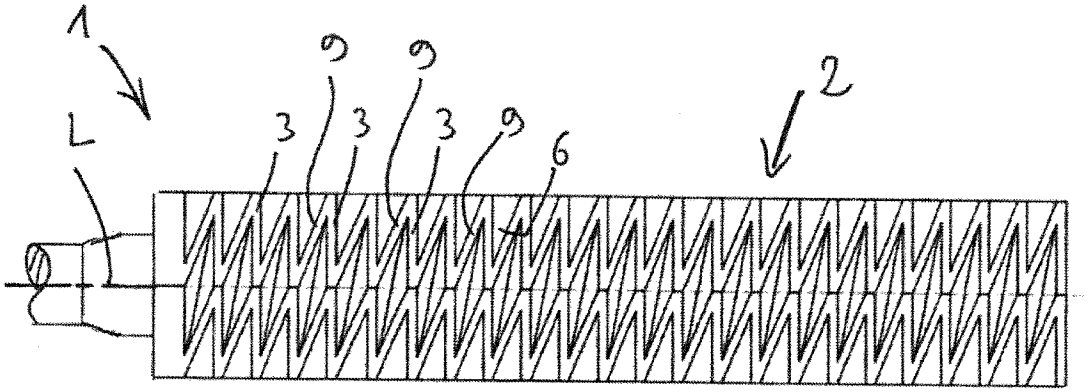
FIG. 18 shows a side view of the fourth exemplary embodiment.
Figure 21:
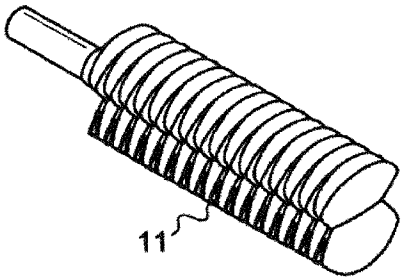
FIG. 21 shows a perspective view of the fifth exemplary embodiment.
Figure 22:
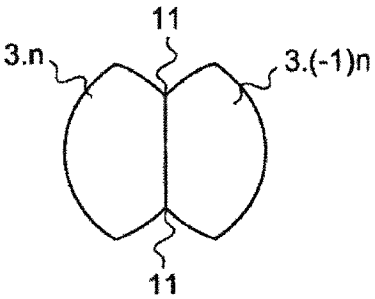
FIG. 22 shows a front view of the fifth exemplary embodiment.
Figure 19:
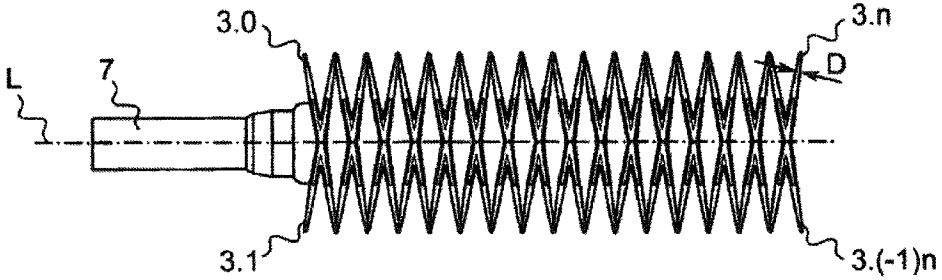
FIG. 19 shows a side view of a fifth exemplary embodiment.
Figure 20:
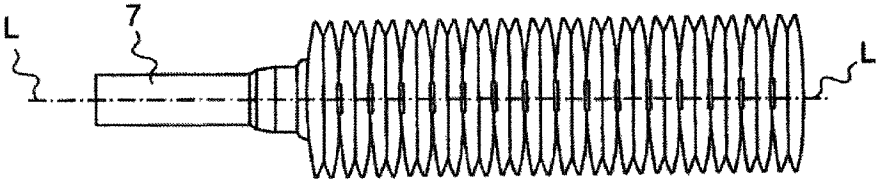
FIG. 20 shows a top view of the fifth exemplary embodiment.
Figure 25:
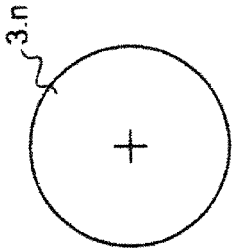
FIG. 25 shows the profile of the plates of the sixth exemplary embodiment when viewed in a direction parallel to the longitudinal axis of the applicator.
Figure 26:
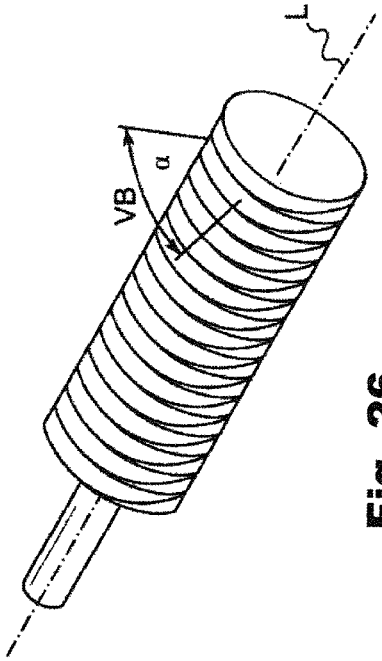
FIG. 26 shows a perspective view of the sixth exemplary embodiment.
Figure 23:
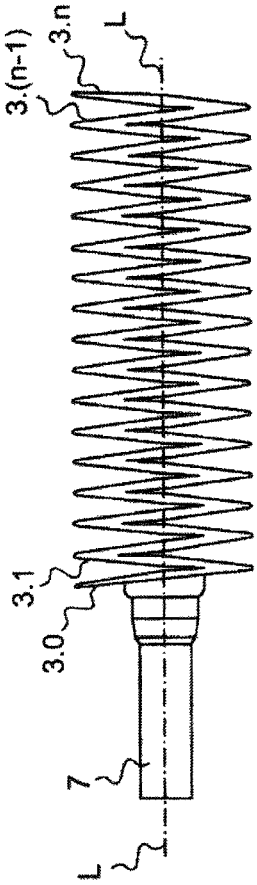
FIG. 23 shows a side view of a sixth exemplary embodiment.
Figure 24:
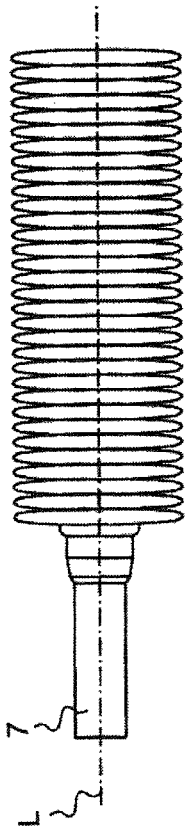
FIG. 24 shows a top view of a sixth exemplary embodiment.

It is particularly advantageous if the plates are embodied so that the on the whole essentially round applicator has a narrow point 11 on at least two opposing sides, see FIG. 18.

The foregoing descriptions apply to the plate thickness D.

FIGS. 23 through 28 show another exemplary embodiment.

In this case, each pair of adjacent plates, which are connected in linear fashion only along their outer edges oriented away from the middle of the applicator, forms a V-shaped element. The applicator is composed of a total of at least 15 such V-shaped elements, which are composed of plates and are integrally joined to one another. The individual plates in this case are curved at least along their connecting lines VB, which extend in the way shown in FIG. 26. Preferably, each connecting line, in relation to the central longitudinal axis, describes an arc that extends around an angle $\alpha$ of 15° to 35°, or better still, an angle $\alpha$ of 20° to 30°. This produces a curved connecting line between each pair of plates that provides the necessary stability by preventing the occurrence of a "film hinge effect" that a straight connecting line would have. Preferably, the individual plates are entirely round, oval, or elliptical.

The invention claimed is:

1. A cosmetic applicator, comprising:

an applicator body;

a wand; and a handle connected to the wand;

wherein the applicator body has a longitudinal axis that coincides with a longitudinal axis of the wand, and the applicator body is composed of a plurality of plates each of which is embodied as a flat section that constitutes two large main surfaces whose surface area is larger by a factor of at least 5 than a surface area of all secondary surfaces of the plate and the flat section is intrinsically closed without any breaks, wherein the plates are integrally joined to one another at their outer edge, and are arranged in a concertina-like fashion, and simultaneously constitute a core of the otherwise core-less applicator having no uninterrupted, continuous core extending coaxial or parallel to its imaginary longitudinal axis, and wherein pockets are formed between adjacent plates, which pockets accommodate a cosmetic and are open toward only one or two immediately adjacent sides of the cosmetic applicator, and wherein at least a majority of the pockets are deep enough that viewed in a direction of their greatest depth the pockets intersect or extend across the longitudinal axis of the applicator body.

2. The cosmetic applicator according to claim 1, wherein each pair of plates forms a V-shaped element and the applicator is composed of a plurality of the V-shaped elements, which are integrally joined to each other along their outsides.

3. The cosmetic applicator according to claim 1, wherein each plate is integrally joined to an adjacent plate both along an outer edge and along an inner edge.

4. The cosmetic applicator according to claim 3, wherein each set of four plates forms an X-shaped element and the cosmetic applicator comprises a plurality of X-shaped elements that are integrally joined to one another at their outsides.

5. The cosmetic applicator according to claim 1, wherein the applicator body has a plurality of intrinsically planar side surfaces and from each of the side surfaces, a plurality of the pockets are accessible, which pockets are closed in relation to a plurality of other side surfaces.

6. The cosmetic applicator according to claim 1, wherein the plates are quadrangular and each plate integrally transitions along its entire length into an adjacent plate in a region along two of its lateral edges so that in this region, a part of the one plate is simultaneously also a part of the immediately adjacent plate.

7. The cosmetic applicator according to claim 1, wherein the applicator body is composed of one piece and is made of plastic.

* * * * *